United States Patent [19]

Glomeau

[11] Patent Number: 4,625,513

[45] **Date of Patent: * Dec. 2, 1986**

[54] CONTROLLED FLOW HYDRAULIC SYSTEM

[75] Inventor: J. Robert Glomeau, Dover, Mass.

[73] Assignee: REXA Corporation, Dover, Mass.

[ * ] Notice: The portion of the term of this patent subsequent to Dec. 10, 2002 has been disclaimed.

[21] Appl. No.: 479,673

[22] Filed: Mar. 28, 1983

[51] Int. Cl.[4] ..... F15B 13/04

[52] U.S. Cl. ..... 60/431; 60/390; 60/415; 91/454; 91/468

[58] Field of Search ..... 60/390, 431, 430, 436, 60/415; 91/451, 452, 454, 390, 468

[56] References Cited

U.S. PATENT DOCUMENTS 2,702,044 2/1955 Johnston ..... 137/102

3,593,522 7/1971 Angert et al. ..... 60/436

*Primary Examiner*—Robert E. Garrett

*Assistant Examiner*—John M. Husar

*Attorney, Agent, or Firm*—Pahl, Lorusso & Loud

[57] ABSTRACT

In the hydraulic system disclosed herein, a flow matching device is employed to implement a system in which filling, emptying and holding of a variable volume load, such as a hydraulic piston, may be accomplished at controlled flow rate by a hydraulic circuit including a flow matching control valve.

4 Claims, 4 Drawing Figures

CONTROLLED FLOW HYDRAULIC SYSTEM

BACKGROUND OF THE INVENTION

This invention is related to U.S. Pat. No. 4,557,180, patented Dec. 10, 1985.

The present invention relates to an electrohydraulic actuator and more particularly to a hydraulic system which provides matched flow rates for filling and emptying a variable volume load and provides positive blocking or holding of the load between changes.

As is understood by those skilled in the art, large process control valves, e.g. such as those employed in petroleum refineries and chemical and power plants are often driven by electrically controllable, hydraulic servo positioners. These devices are commonly referred to as electrohydraulic actuators. Such electrohydraulic actuators commonly employ a powerful hydraulic piston and a self-contained, positive displacement pump which provides a source of hydraulic power, both for stroking the piston and for holding same at any selected position within its stroke. Typically the pump is run continuously and the flow to the actuator is modulated by convential throttling means such as a flapper nozzle, spool valve or jet pipe system. The throttling means, in turn, is responsive to an electrical command signal through the use of force coils, torque motors or other electromagnetic devices, employed in conjunction with a position feedback loop.

As a result of the continuous pump operation, the efficiency of present state-of-the-art electro hydraulic actuators is, in the large majority of applications, in the order of five percent or less. Inherently a majority of the hydraulic energy generated by the pump is wasted as heat while the actuator is immobile. As is understood by those skilled in the art, the actuator is, in fact, immobile much of the time in most control valve applications, particularly in large and rather stable processes. Not only is the loss of energy wasteful, the heat created is itself troublesome. Typically, in an effort to minimize losses, the present state-of-the-art electro hydraulic actuators are operated under medium to low hydraulic pressure which necessitates cylinders having larger effective area and pumps having larger flow capacity, both factors being detrimental to cost of construction.

Among the several objects of the present invention may be noted the provision of electro hydraulic actuator in which the pump need be operated only when the piston is moving; the provision of such an actuator in which the piston position's volume is maintained by positive acting check valves when the piston is immobile; the provision of such a system which may be precisely controlled; the provision of such a system which has a symmetrical response; the provision of such a system which is highly efficient; the provision of such a system which is reliable and which is of relatively simple and inexpensive construction. Other objects and features will be in part apparent and, in part, pointed out hereinafter.

SUMMARY OF THE INVENTION

In accordance with the practice of the present invention, a variable volume load, such as a hydraulic cylinder, is driven by a bi-directional pump through a flow-matching control valve having a source port, a load port and a drain port, a hydraulic flow into the source port producing a controlled flow into the load port, both flows exiting through the drain port. A fluid reservoir is connected to both sides of the pump through respective check valves permitting flow from the reservoir to the pump. One side of the pump is connected to the source port of the control valve while the load port is connected to the variable volume load. The drain port of the control valve is connected back to the reservoir. The other side of the pump is connected to the load through a check valve permitting flow from the pump to the load. Accordingly, operation of the pump in one direction increases the load volume while operation in the opposite direction causes the load volume to decrease at a rate matching the pump flow. The load volume is maintained when the pump is stopped.

BRIEF DESCRIPTION OF THE DRAWINGS

Corresponding references characters indicate corresponding parts throughout the several views of the drawings.

DESCRIPTION OF THE PREFERRED EMBODIMENT

Figure 1:
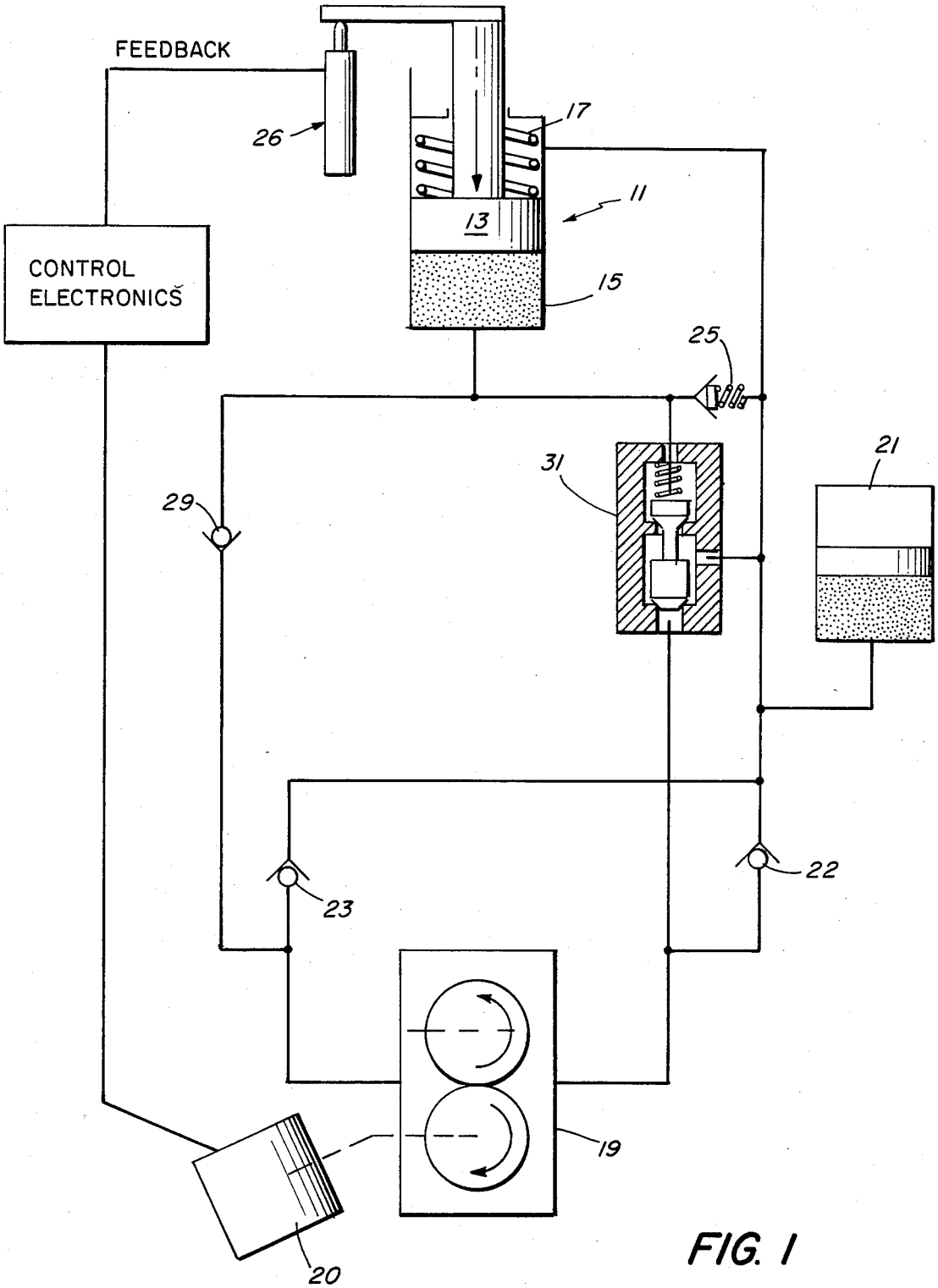
FIG. 1 is a diagramatic illustration of an electrohydraulic actuator system constructed in accordance with the present invention.

As indicated previously, electro-hydraulic actuators operating process control valves typically employ a relatively massive hydraulic prime mover. Referring now to FIG. 1, such a prime mover is indicated generally by reference character 11 and comprises a piston 13 and a cylinder 15. To provide a return force and a modicum of fail-safe operation, the piston is normally biased by a heavy spring, as indicated at 17, toward a return position.

A bidirectional positive displacement pump 19 is utilized for providing hydraulic fluid under a pressure suitable for operating the cylinder 15. A pressurized accumulator 21 provides a reservoir of hydraulic fluid. This reservoir is connected, through respective check valves 22 and 23, to both sides of pump 19. Pump 19 is preferably of the positive displacement, meshing gear type and is driven in either direction by a stepping motor 20. Movement of the piston 13 is tracked by a suitable transducer e.g. a side wire potentiometer as indicated at 26, so as to provide a suitable feedback signal or voltage. A pressure release valve is provided, as indicated by reference character 25, for limiting the maximum pressure which can be applied to the cylinder 15. The cylinder 15 is connected, through a check valve 29, to one side of the pump and, through a flow matching control valve 31, to the other side of the pump.

Figure 2:
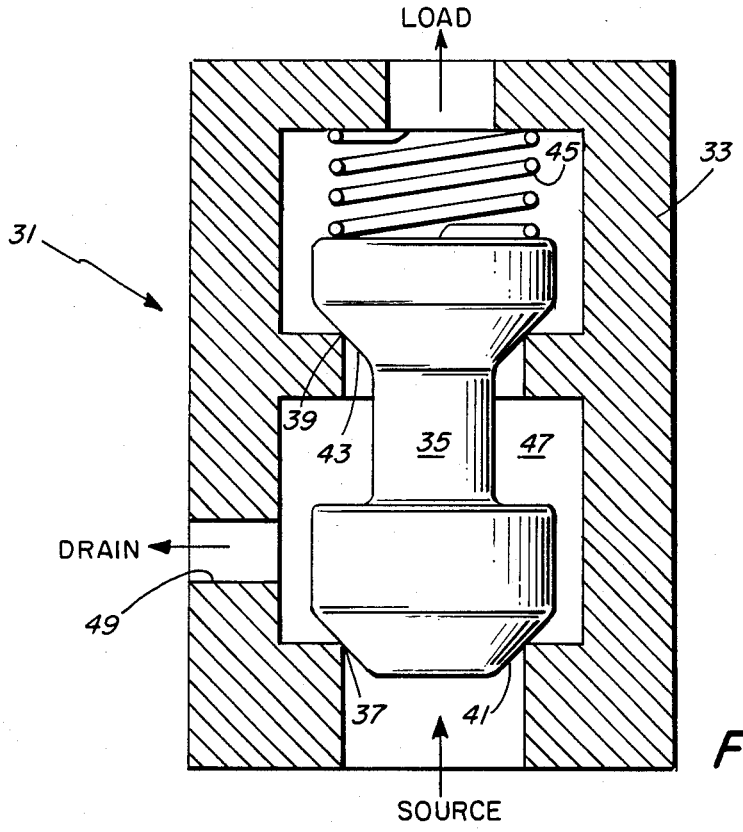
FIG. 2 is a cross sectional view of a flow matching valve employed in the system of FIG. 1.

A relatively simple version of a flow-matching control valve is illustrated in FIG. 2 and serves well for the purpose describing the basic valve function and overall system operation. Referring now to FIG. 2, the valve illustrated there comprises a generally cylindrical or tubular body portion 33 within which operates a plug member 35. The valve body 33 provides a first valve seat 37 and a second valve seat 39 which is axially displaced along the body from the first valve seat. Both valve seats face in the same direction.

The plug member 35 includes a first valving surface 41 and a second valving surface 43 which mate with the seats 37 and 39 respectfully. The axial displacement between the valving surfaces 41 and 43 matches the axial spacing of the seats 37 and 39 so that the two ports open synchronously. The port controlled by the valving surface 41 in cooperation with the seat 37 may be considered the source or supply port while the port controlled by the second valving surface 43 in conjunction with the second valve seat 39 may be considered the load port. While the plug member 35 is preferably lightly biased in the direction tending to close the ports, e.g. by a spring 45, the plug member is essentially floating in the body so as to be responsive to any difference in pressure between the supply side and the load side.

The valve body 33 and plug member 35 provide, between them, an intermediate chamber 47. A drain port opens into chamber 47, as indicated at reference character 49. While the valve body 33 and plug member 35 are illustrated as integral structures for the purpose of explanation, it will be understood by those skilled in the mechanical arts that these parts are necessarily assembled of multiple components so as to permit the construction of interlocking assembly shown in the drawings.

The valve of FIG. 2 is functional to provide flow matching characteristics and, in effect, reciprocative check valving. This operation may best be understood in conjunction with the description of the overall system.

When the pump 19 is driven in a direction producing flow from right to left as seen in FIG. 1, flow from the high pressure side of the pump is blocked by the check valve 23 but is passed by the check valve 29 so that flow increases the operating volume of the cylinder 15. In this situation, the control valve 31 acts simply as a positively operating check valve.

When the pump is driven in the opposite direction, producing flow from left to right as seen in FIG. 1, the flow from the high pressure side of the pump is blocked by the check valve 22 but is admitted into the source port of the control valve 31. As soon as the pressure at the high pressure side of the pump equals the the load pressure, i.e. the pressure in the cylinder 15, the plug member is lifted from the valve seats opening the source port. However, at the same time that the source port of the control valve is open, the load port will also be opened by a like amount. Since the intermediate chamber is vented back to the accumulator 21, it can be seen that the flow generated by the pump will cause an equal flow to pass through the load port of the control valve, with both flows exiting the control valve through the drain port so as to return to the accumulator or sump. Because the emptying flow from the cylinder 15 is maintained substantially equal to the flow out of the pump, it can be seen that the overall sensitivity or "gain" of the hydraulic system is the same for both filling or emptying, a highly desirable attribute as will be understood by those skilled in the servo-control art.

Figure 3:
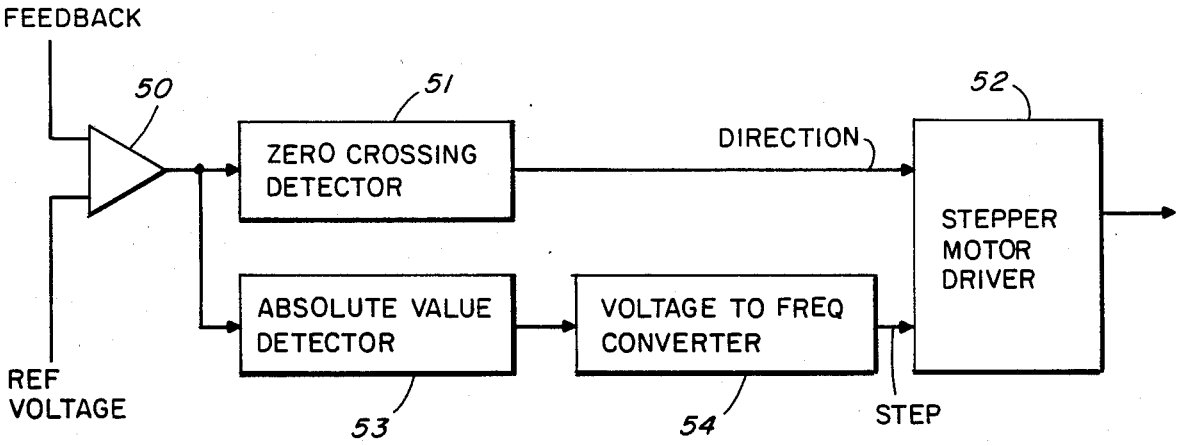
FIG. 3 is a block diagram of control electronics suitable for use in the electrohydraulic actuator system of FIG. 1.

While various control schemes for controlling the operation of the pump 19 may be implemented, one particular such scheme is shown by way of example in FIG. 3.

The feedback signal obtained from the potentiometer 26 is compared, in a differential amplifier 50, with a reference voltage representing the desired position of the piston thereby to generate an error signal representing the difference between the desired and actual positions for the piston. A zero crossing detector circuit 51 provides a signal indicating the sense or polarity of the error and this signal is provided to the direction control input of a conventional stepper motor driving circuit, indicated by reference character 52. A signal proportional to the amplitude of the error, independent of polarity, is provided by an absolute value detector circuit, indicated by reference character 53. As is understood, this circuitry may be constituted by a simple array of diodes. The signal porportional to the absolute value of the error is provided to enable a voltage-to-frequency converter circuit 54 whose output is, in turn, applied to the step signal input of the stepper motor driving circuit 52. From the foregoing, it will be understood by those skilled in the art that the stepper motor 20 will be energized in a direction which reverses in accordance with the sensed direction of the error and at a speed which is proportional to the magnitude of the error. This operation thus closes the servo-loop so that the position of the piston will follow variations in the set point reference signal, as desired. However, as compared with conventional electro-hydraulic actuators in which the pump runs continuously, the stepper motor 20 is energized only when an error exists and the level of energization is proportional to the error. In relatively stable overall systems therefore, the motor is energized only intermittently. As is understood, this both reduces the average power requirement and the amount of heat dissipated in the system. Further, when the motor is not energized, the position of the piston 13 is maintained by positive acting check valve structures and is not a function of the leakage or backflow which would occur through the pump 19 if the load pressure were maintained across the pump itself. It may also be pointed out that, other than the the control valve 31, all of the valves in the system are essentially simple check valve constructions and no eleaborate reversing or four-way valves are required, as would typically be the case in convential hydraulic servo control systems.

While the form of control valve construction shown is conceptually simple and thus is useful for the purposes of explanation, it should be understood that other flow matching devices might also be used. A presently preferred construction for the flow matching valve is disclosed in my copending application entitled "Control Valve and Hydraulic System Employing Same" being filed on even date herewith, and that preferred form of control valve construction is shown in FIG. 4.

While the operation of the relatively simple valve shown in FIG. 2 is readily understood so that it serves well for the purpose of illustration, it will be understood by those skilled in the art that the balanced operation of such a construction at small flows becomes highly dependent on the accuracy with which the critical dimensions may be matched, i.e. the length of the plug member 35 between the surfaces 41 and 43 as compared with the actual separation between the valve seats 37 and 39. Maintenance of critical dimensions is facilitated with the arrangement shown in FIG. 4 and this construction is presently preferred.

Figure 4:
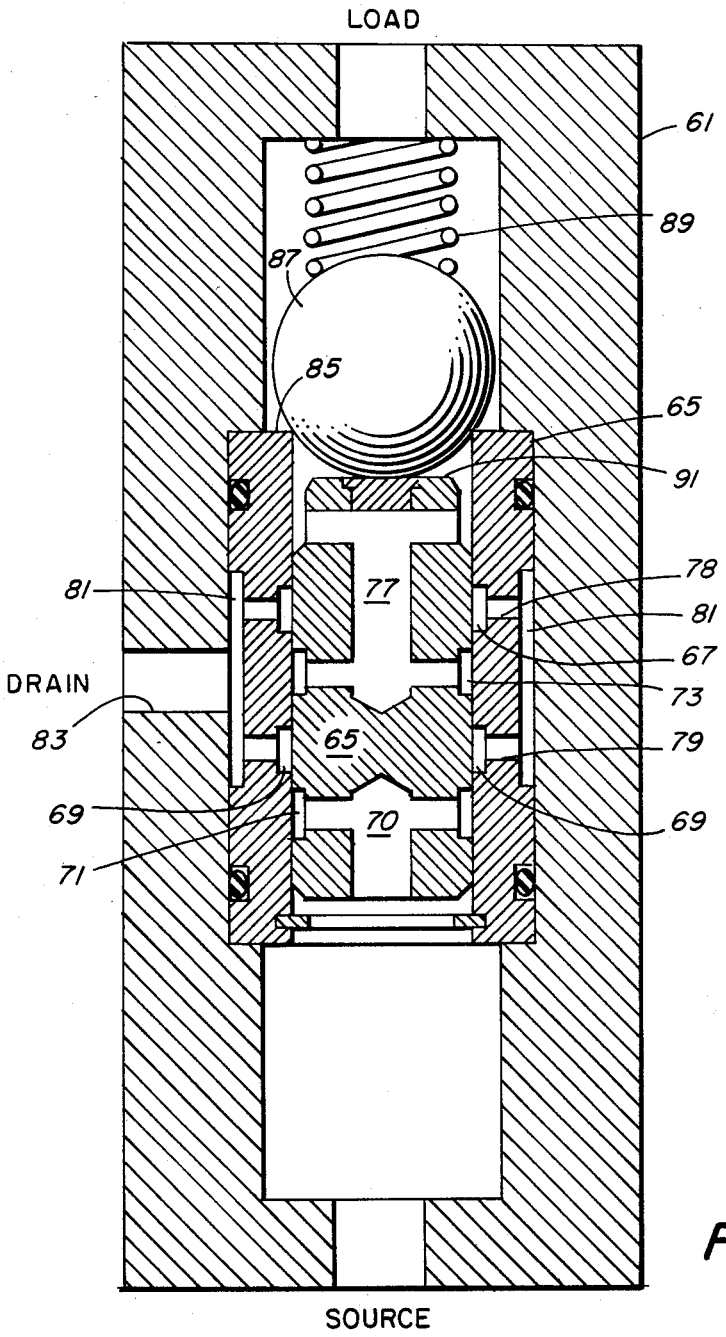
FIG. 4 is a cross sectional view of an alternate mechanical construction of a control valve suitable for use in the electrohydraulic system of FIG. 1.

With reference to the device shown in FIG. 4, it will be apparent to those skilled in the art that the constructional techniques are quite similar to those employed in the making of spool valves where close tolerances are regularly achieved. Fitting within an overall body assembly 61 is a sleeve 63 and a piston 65. Sleeve 65 is stationary within the body member 61 while the piston 65 is slidable axially within the sleeve 63, i.e. similar to the manner in which the spool element in a spool valve is slidable. Preferably, the piston is lapped to the sleeve to provide a close, low leakage fit. The sleeve 63 is provided with a pair of internal annular grooves 67 and 69 with a precise axial separation between them. The piston 65 is provided with a matching pair of external annular grooves 71 and 73 with an axial separation between these grooves which matches the axial separation between the grooves 67 and 69 on the sleeve.

Within the piston 65 a first passageway system 70 connects the groove 71 with the source port while a second passageway system 77 provides communication from the groove 73 to the load port end of the sleeve 63. Cross ports 78 and 79 in the sleeve connect the grooves 67 and 69, through a common annular chamber 81, to a drain port connection 83.

The upper end of the sleeve 63 provides a valve seat, as indicated by reference character 85 and a spherical valving element 87 is lightly biased into contact with this seat by a spring 89. A projecting portion 91 of the piston 65 is formed to lift the valving element 87 from the seat 85 just as the annular grooves on the piston come adjacent the respective annular grooves on the sleeve 63.

Ignoring for a moment the action of the spherical valving element 87, it can be understood that the cooperative action of the piston and sleeve portion of the valve is essentially similar to the action provided by the valve of FIG. 2. As the pressure at the source port comes equal to that at the load port, the piston moves upwardly opening the two valving sections in synchronism. If the drain port is closed, fluid flow introduced into the source port will proceed, through the common intermediate chamber 81 on to the load port. If the drain port is open, however, matching flows from the source port and the load port will both exit through the drain port. These flows will be well matched in volume since the valve openings are closely matched and since the pressure drop in each channel will be equal.

This basic operation is not changed by the presence of the spherical valving element at the top of the sleeve since the spherical valving element 87 is lifted from the valve seat at the same time or slightly before the annular grooves open to each other. However, any time the source pressure drops significantly below the load pressure the spherical valving element acts as a simple but highly effective check valve eliminating backflow from the load. Since the desired sealing requirement is met by this element, there is no requirement for an absolute seal between the piston and the sleeve. Since the overall operation of the valve device of FIG. 4 is basically the same as that of the valve device of FIG. 2, it will also be seen that the valve device of FIG. 4 may be directly substituted in the novel hydraulic system of FIG. 3 which will continue to provide the desired function and advantages.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

I claim:

1. A hydraulic system comprising:

a fluid reservoir;

a bidirectional pump;

a variable volume load having an inlet port, said load being moved in one direction by the introduction of fluid through said inlet port and being moved in the opposite direction by the withdrawal of fluid from said inlet port;

a flow matching control valve having a source port, a load port and a drain port, said control valve being characterized in that a hydraulic flow into the source port produces a matching controlled flow into the load port, both flows exiting the control valve together through said drain port;

means connecting said reservoir to both sides of said pump through respective check valves permitting flow from the reservoir toward the pump;

means connecting one side of said pump to the source port of said control valve;

means connecting the load port of said control valve to the inlet port of said load;

means connecting the drain port of said control valve to said reservoir; and means connecting the other side of said pump to the inlet port of said load through a check valve permitting flow from said pump toward said load.

2. A hydraulic system comprising:

a fluid reservoir;

a bidirectional pump;

a variable volume load;

a flow matching control valve having:

a generally tubular body;

a source port at a first axial position along said body;

a load port at a second position along said body which is axially spaced from said first position;

a drain port between said source and load ports;

in said body, an axially floating plug member which is movable axially within said tubular body responsive to any difference in the pressures at said source and load ports, said body including rigidly connected first and second surfaces which are axially spaced, said plug member including a pair of rigidly connected third and fourth surfaces which are axially spaced, said first and second surfaces simultaneously mating with said third and fourth surfaces such that axial movement of said plug member will progressively open said source and load ports in synchronism, said body and plug member providing, between them a chamber which is located axially between said source and load ports and with which said source and load ports communicate when open;

a drain port opening directly into said chamber axially between said first and second surfaces;

means connecting said reservoir to both sides of said pump through respective check valves permitting flow from the reservoir toward the pump;

means connecting one side of said pump to the source port of said control valve;

means connecting the load port of said control valve to said load;

means connecting the drain port of said control valve to said reservoir; and means connecting the other side of said pump to said load through a check valve permitting flow from said pump toward said load.

3. A hydraulic system comprising:
a fluid reservoir;
a bidirectional pump;
a variable volume load having an inlet port, said load being moved in one direction by the introduction of fluid through said inlet port and being moved in the opposite direction by the withdrawal of fluid from said inlet port;
a flow matching control valve having:
a cylindrical body providing first and second, axially displaced, valve seats both of which face in the same direction;
in said body, a plug member which is movable axially in response to a pressure differential and which includes valving surfaces which are axially spaced so as to mate simultaneously with said seats and to open synchronously, one of said mating pairs forming a source port and the other forming a load port;
said body and plug member providing, between them, a chamber which is located axially between said valve seats;
a drain port opening into said chamber;
means connecting said reservoir to both sides of said pump through respective check valves permitting flow from the reservoir toward the pump;
means connecting one side of said pump to the source port of said control valve;
means connecting the load port of said control valve to the inlet port of said load;
means connecting the drain port of said control valve to said reservoir; and
means connecting the other side of said pump to the inlet port of said load through a check valve permitting flow from said pump toward said load.

4. A hydraulic system comprising:
a fluid reservoir;
a bidirectional pump;
a variable volume load having an inlet port, said load being moved in one direction by the introduction of fluid through said inlet port and being moved in the opposite direction by the withdrawal of fluid from said inlet port;
a flow matching control valve having:
a generally tubular sleeve;
a piston axially slidable within said sleeve, said sleeve and piston having a first pair of mating valving surfaces and, axially displaced from said first pair, a second pair of mating valving surfaces, said valving surfaces being matched to open in synchronism;
in said piston, a first passageway from said first valving surface to one end of said piston to connect with a source port and a second passageway opening from said second valving surfaces to the other end of said piston to connect with a load port;
in said sleeve, passageways connecting both sets of said valving surfaces to a drain port
at one end of said sleeve, a valve seat;
a valving member adapted to mate with and close off said seat, said piston including a portion which, during movement of the piston, engages said valving member to lift it off said seat substantially at the same time that said mating valving surfaces open;
means connecting said reservoir to both sides of said pump through respective check valves permitting flow from the reservoir toward the pump;
means connecting one side of said pump to the source port of said control valve;
means connecting the load port of said control valve to the inlet port of said load;
means connecting the drain port of said control valve to said reservoir; and
means connecting the other side of said pump to the inlet port of said load through a check valve permitting flow from said pump toward said load.

* * * * *